US006767881B1

(12) United States Patent
Griese et al.

(10) Patent No.: US 6,767,881 B1
(45) Date of Patent: Jul. 27, 2004

(54) CLEANING CONCENTRATE

(75) Inventors: Greg G. Griese, Hudson, WI (US); Mark Levitt, St. Paul, MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 10/391,639

(22) Filed: Mar. 19, 2003

(51) Int. Cl.[7] ..... C11D 1/70; C11D 1/72; C11D 3/37; C11D 3/50

(52) U.S. Cl. ..... 510/421; 510/101; 510/201; 510/238; 510/239; 510/240; 510/245; 510/365; 510/426; 510/475; 510/506

(58) Field of Search ..... 510/101, 201, 510/238, 237, 240, 245, 365, 421, 426, 475, 506

(56) References Cited

U.S. PATENT DOCUMENTS

| | | | | |
|---|---|---|---|---|
| 3,048,548 | A | | 8/1962 | Martin et al. |
| 3,334,147 | A | | 8/1967 | Brunelle et al. |
| 3,442,242 | A | | 5/1969 | Laskey et al. |
| 4,414,128 | A | * | 11/1983 | Goffinet ..... 510/405 |
| 4,618,914 | A | | 10/1986 | Sato et al. |
| 4,830,773 | A | | 5/1989 | Olson |
| 5,023,267 | A | | 6/1991 | Clarkson et al. |
| 5,462,690 | A | * | 10/1995 | Rhinesmith ..... 510/417 |
| 5,965,512 | A | | 10/1999 | Smyth et al. |
| 2001/0014658 | A1 | | 8/2001 | Smith et al. |

* cited by examiner

*Primary Examiner*—Brian P. Mruk
(74) *Attorney, Agent, or Firm*—Crompton, Seager & Tufte LLC

(57) ABSTRACT

Compositions of the invention include: (a) a terpene compound; (b) a surfactant; and (c) an ethoxylated aryl alcohol.

23 Claims, No Drawings

CLEANING CONCENTRATE

BACKGROUND OF THE INVENTION

The invention relates to cleaner/degreaser compositions and, more particularly, to stable cleaner/degreaser compositions that includes a terpene.

While not wishing to be held to any theory as to the nature of the cleaning and degreasing action of presently available compositions, it is believed that highly or infinitely water soluble organic solvents presently used in both retail as well as industrial and institutional cleaner/degreaser compositions are too hydrophilic in nature to function effectively in removing hydrophobic "oleophilic" soilants, especially in the presence of diluting water. As the level of the latter is increased to bring conventional compositions to ready to use strength, the solvating action of the organic solvent is drastically reduced with a consequent and marked reduction in the cleaning/degreasing action required for effective cleaning and oily soilant removal.

There remains a need, therefore, for cleaning, degreaser compositions with improved cleaning and degreasing capabilities without the other deficiencies of presently available cleaner/degreaser compositions.

SUMMARY OF THE INVENTION

Generally, the present invention relates to terpene based cleaning compositions that are stable in concentrate and dilute use solution form.

One embodiment of the invention includes compositions of the invention include: (a) a terpene compound; (b) a surfactant; and (c) an ethoxylated aryl alcohol having the formula:

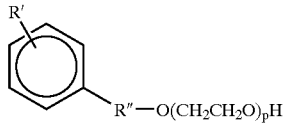

where, p is an interger from 2 to 40; R' is hydrogen, $(C_1–C_3)$alkyl, $(C_1–C_3)$alkoxy, or $(C_1–C_3)$alkenyl; and R" is a bond or $(C_1–C_3)$alkyl, $(C_1–C_3)$alkoxy, or $(C_1–C_3)$alkenyl.

Another embodiment of the invention includes a composition including: 1–65% wt D-limonene compound; 0.5–40% wt surfactant and 0.5–40% wt. of an ethoxylated aryl alcohol having the formula:

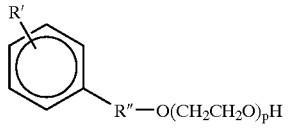

where, p is an interger from 2 to 40; R' is hydrogen, $(C_1–C_3)$alkyl, $(C_1–C_3)$alkoxy, or $(C_1–C_3)$alkenyl; and R" is a bond or $(C_1–C_3)$alkyl, $(C_1–C_3)$alkoxy, or $(C_1–C_3)$alkenyl.

The above summary of the present invention is not intended to describe each disclosed embodiment or every implementation of the present invention. The Detailed Description and Examples which follow more particularly exemplify these embodiments

DETAILED DESCRIPTION

While the invention is amenable to various modifications and alternative forms, specifics thereof have been shown by way of the Example and will be described in detail. It should be understood, however, that the intention is not to limit the invention to the particular embodiments described. On the contrary, the intention is to cover all modifications, equivalents, and alternatives falling within the spirit and scope of the invention.

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subbsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "alkoxy" refers to refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples include, methoxy, ethoxy, propoxy, t-butoxy, and the like.

The term "alkenyl" or "alkenylene" refers to a straight or branched chain divalent hydrocarbon radical having a specified number of carbon atoms and one or more carbon—carbon double bonds. Alkenylene groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkenyl" or "alkenylene" include, but are not limited to, ethene-1,2-diyl, propene-1,3-diyl, and the like.

The term "cycloalkyl" refers to an alicyclic hydrocarbon group having a specified number of carbon atoms. Cycloalkyl groups include those with one to twelve carbon atoms. Cycloalkyl groups may be saturated or unsaturated, unsubstituted or substituted with those substituents that do not interfere with the specified function of the composition. Cycloalkyl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a cycloalkyl ring may be optionally fused to one or more of another heteroaryl ring(s), aryl ring(s), or cycloalkyl rings. Examples of "cycloalkyl" include, but are not limited to, cyclopropyl, cyclobutyl, cyclopentyl, cyclohexyl, cycloheptyl, or cyclooctyl, and the like.

The term "heterocyclic" or "heterocyclyl" refers to a monovalent three to twelve-membered non-aromatic ring containing one or more heteroatomic substitutions independently selected from S, O, or N and having zero to five degrees of unsaturation. Heterocyclyl groups may be unsubstituted or substituted with those substituents that do not interfere with the specified function of the composition. Heterocyclyl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a heterocyclic ring may be optionally fused to one or more of another heterocyclic ring(s), heteroaryl ring(s), aryl ring(s), or cycloalkyl rings. Examples of "heterocyclic" include, but are not limited to, tetrahydrofuryl, pyranyl, 1,4-dioxanyl, 1,3-dioxanyl, piperidinyl, pyrrolidinyl, morpholinyl, tetrahydrothiopyranyl, tetrahydrothiophenyl, and the like.

The term "aryl" refers to monovalent unsaturated aromatic carbocyclic radicals having a single ring, such as phenyl, or multiple condensed rings, such as naphthyl or anthryl. Aryl groups may be unsubstituted or substituted with those substituents that do not interfere with the specified function of the composition. Aryl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such an aryl ring may be optionally fused to one or more of another heterocyclic ring(s), heteroaryl ring(s), aryl ring(s), or cycloalkyl rings. Examples of "aryl" include, but are not limited to, phenyl, 2-naphthyl, 1-naphthyl, biphenyl, 2-hydroxyphenyl, 2-aminophenyl, 2-methoxyphenyl and the like.

The term "heteroaryl" refers to a monovalent five to seven membered aromatic ring radical containing one or more heteroatoms independently selected from S, O, or N. Heteroaryl groups may be unsubstituted or substituted with those substituents that do not interfere with the specified function of the composition. Heteroaryl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a "heteroaryl" ring may be optionally fused to one or more of another heterocyclic ring(s), heteroaryl ring(s), aryl ring(s), or cycloalkyl rings. Examples of "heteroaryl" include, but are not limited to, furyl, thiophenyl, pyrrolyl, imidazolyl, pyrazolyl, triazolyl, tetrazolyl, thiazolyl, oxazolyl, isoxazolyl, oxadiazolyl, thiadiazolyl, isothiazolyl, pyridinyl, pyridazinyl, pyrazinyl, pyrimidinyl, quinolinyl, isoquinolinyl, benzofuryl, benzothiophenyl, indolyl, and indazolyl, and the like.

The term "halo" and "halogen" refer to chloro, bromo, fluoro, and iodo.

The term "Hydrophilic Lipophilic Balance (HLB)" refers to a surfactant's solubility in water. An HLB scale was derived as a means for comparing the relative hydrophilicity of anphiphilic molecules. Molecules with an HLB value of 10 or greater indicate that the molecule is hydrophilic and soluble in water. Molecules with an HLB value less than 10 indicate that the molecule is hydrophobic and insoluble in water. The HLB system is well known to skilled surfactant chemists and is explained in the literature such as in the publication, "The HLB System," ICI Americas (1987).

Compositions

The compositions of the invention include: (a) a terpene compound; (b) a surfactant; and (c) an ethoxylated aryl alcohol. The composition forms a stable cleaning concentrate and is stable when diluted to a use solution.

Terpene Compound

Terpene compounds may also be included in the present cleaning compositions. As used herein, the term "terpene compound" refers to a class of acyclic and cyclic unsaturated compounds derived from natural essential oils and resins having at least 10 carbon atoms. Any number of terpene compounds, including combinations of these terpenes may be used in the present invention.

Suitable terpenes include diterpenes, triterpenes, and tetraterpenes which are generally head-to-tail condensation products of modified or unmodified isoprene molecules. The terpenes may be mono-, bi-, tri-, or tetracyclic compounds having varying degrees of unsaturation. Also contemplated as useful in the present invention are terpene derivatives, e.g., alcohols, aldehydes, etc., sometimes referred to as terpenoids.

A preferred terpene is d-limonene. D-limonene is a terpene which occurs naturally in plants. It is a monocylic unsaturated terpene which is generally a by-product of the citrus industry, derived from the distilled rind oils of oranges, grapefruits, lemons, and the like. A discussion concerning d-limonene and its derivation from numerous sources is set forth in Kesterson, J. W., "Florida Citrus Oil," Institute of Food and Agriculture Science, University of Florida, December, 1971. D-limonene exhibits low human toxicity and is considered environmentally benign. It functions in the present inventive formulation as a portion of the solvent phase, for solubilizing grease. D-limonene is commercially available from Florida Chemical Company and from SMC Glidco Organics.

Terpenes such as D-limonene are difficult to couple into water especially at the concentration of the terpene increases such as in terpene concentrates. The solubilizing system claimed and described herein allows for terpene concentrates to form stable solutions with water in concentrate form and when diluted while providing an effective degreasing composition.

As will be apparent to those skilled in the art, the above-listed terpenes are merely illustrative and various other terpenes meeting the criteria set out above may also be used in the practice of the invention. The terpene may be present in the composition from 0.01 wt % or 1 to 65 wt %.

Surfactant

A surfactant may be present in the composition of the invention. The surfactant or surfactant admixture can be selected from water soluble or water dispersible nonionic, semi-polar nonionic, anionic, cationic, amphoteric, or zwitterionic surface-active agents; or any combination thereof. The surfactant can be a specified combination of surfactants such as, for example, a anionic and nonionic surfactant, a anionic and two or more nonionic surfactants, or a anionic and a hydrophobic nonionic and a hydrophilic nonionic surfactant. The particular surfactant or surfactant mixture chosen for use in the process and products of this invention can depend on the conditions of final utility, including method of manufacture, physical product form, use pH, use temperature, foam control, and soil type. For a discussion of surfactants, see Kirk-Othmer, Encyclopedia of Chemical Technology, Third Edition, volume 8, pages 900–912. The composition may include a surfactant or combination of surfactants in an amount effective to provide a desired level of cleaning, such as 0.5–40 wt %, or 1–30 wt %.

Anionic surfactants may include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like.

Anionic surfactants may also include an amine salt of a fatty acid. An amine salt of a fatty acid may include a $(C_8–C_{22})$ fatty acid anion and a cation of the formula $NR_4$ where $R_4$ can be one or two groups independently selected from hydrogen, $(C_1–C_{18})$alkyl, $(C_1–C_{18})$alkoxy, or $(C_2–C_{18})$ alkenyl.

A preferred amine salt of a fatty acid is formed by combining a linear $C_{11}$ fatty acid with an alcohol amine. A preferred fatty acid is tall oil fatty acid. A preferred alcohol amine is monoisopropanol amine available as "Dowanol" from Dow Chemical Company, Midland, Mich. As will be apparent to those skilled in the art, the above-listed fatty acid and alcohol amine are merely illustrative and various other fatty acids and alcohol amines meeting the criteria set out above may also be used in the practice of the invention. The amine salt of a fatty acid may be present in the composition from 0.01 wt % or 0.5 to 15 wt %.

Nonionic surfactants may include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds. Silicone surfactants such as the ABIL™ B8852 can also be used.

Nonionic surfactants may also include a hydrophilic alcohol ethoxylate. A hydrophilic alcohol ethoxylate has sufficient ethylene oxide to obtain an HLB of at least 10. The hydrophilic alcohol ethoxylate may have a formula (II):

$$R_2—(OC_2H_4)_m—(OC_3H_6)_{n—OH} \quad \text{(II)}$$

where $R_2$ may be a $(C_6–C_{24})$alkyl or $(C_8–C_{18})$alkyl or $(C_{10–C_{12})}$alkyl, m can be an integer of 5 to 12 or 6 to 8, n is an integer of 0 to 6 or 0 to 3 and m+n is and integer of 6 to 20 or 7 to 12.

A preferred hydrophilic alcohol ethoxylate is a linear $C_{11}$ primary alcohol ethoxylate with 7 moles of ethylene oxide. This compound is commercially available as Neodol™ 1-7 from Shell Chemical Company, Houston Tex. As will be apparent to those skilled in the art, the above-listed hydrophilic alcohol ethoxylates are merely illustrative and various other hydrophilic alcohol ethoxylates meeting the criteria set out above may also be used in the practice of the invention. The hydrophilic alcohol ethoxylates may be present in the composition from 0.01 wt % or 0.5 to 30 wt %.

Nonionic surfactants may also include a hydrophilic alcohol ethoxylate. A hydrophilic alcohol ethoxylate has a limited amount of ethylene oxide to obtain an HLB of at less than 10. The hydrophobic alcohol ethoxylate may a formula (III):

$$R_3—(OC_2H_4)_r—(OC_3H_6)_{s—OH} \quad \text{(III)}$$

where $R_3$ can be a $(C_6–C_{24})$alkyl or $(C_8–C_{18})$alkyl or $(C_{10–C_{12})}$alkyl, r may be an integer of 1 to 4, s is an integer of 0 to 3 and r+s is and integer of 1 to 3.

A preferred hydrophobic alcohol ethoxylate is a linear $C_{11}$ primary alcohol ethoxylate with 3 moles of ethylene oxide. This compound is commercially available as Neodol™ 1-3 from Shell Chemical Company, Houston Tex. As will be apparent to those skilled in the art, the above-listed hydrophobic alcohol ethoxylates are merely illustrative and various other hydrophobic alcohol ethoxylates meeting the criteria set out above may also be used in the practice of the invention. The hydrophobic alcohol ethoxylates may be present in the composition from 0.01 wt % or 0.5 to 20 wt %.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl$(C_{12}–C_{18})$dimethylbenzyl ammonium chloride, n-tetradecyl dimethylbenzylammonium chloride monohydrate, a naphthylene-substituted quaternary ammonium chloride such as dimethyl-1-naphthylmethylammonium chloride, and the like; and other like cationic surfactants.

Ethoxylated Aryl Alcohol

The ethoxylated aryl alcohol may have the general formula:

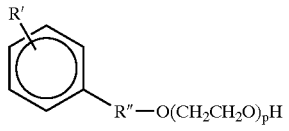

where p represents 2 to 40 or 4 to 15 or 2 to 15 or 2, 3, 4, 5, 6, 7, 8, 9, or 10 and R' represents hydrogen, $(C_1–C_3)$alkyl, $(C_1–C_3)$alkoxy, or $(C_1–C_3)$alkenyl and R" represents a bond or $(C_1–C_3)$alkyl, $(C_1–C_3)$alkoxy, or $(C_1–C_3)$alkenyl. Preferred ethoxylates are those derived from phenol itself and benzyl alcohol and those containing 2 to 15 ethoxylate groupings. Especially preferred is "Ethylan HB4" which is a phenol ethoxylate containing around 4 ethoxylate units.

Ethoxylated aryl alcohol may be produced by reacting a desired alcohol with a desired number of ethoxylate moles at standard reaction conditions such as, 30–40 psi pressure, 300–360 degree F., with 0.2–0.5 wt % catalyst neutralized with acid. The reaction can be illustrated by the following:

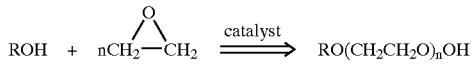

As will be apparent to those skilled in the art, the above-listed ethoxylated aryl alcohols are merely illustrative and various other ethoxylated aryl alcohols meeting the criteria set out above may also be used in the practice of the invention. The ethoxylated aryl alcohols may be present in the composition from 0.01 wt % or 0.5 to 40 wt %.

Water

The compositions of the invention may include water. The solubilizing system described above increases the solubility of the terpene that is at least partially insoluble in water. The solubilizing system described above allows the terpene to be completely miscible in the concentrate and use solution when diluted with water. Water may be present in the composition from 0.01% wt or 0.01 to 99 wt %.

The composition may include any amount of D'Limonene, surfactant and ethoxylated aryl alcohol, and optionally water. The compositions may include 1–65% wt D'Limonene, 0.5–40% wt surfactant and 0.5–40% wt ethoxylated aryl alcohol based on total weight of D'Limonene, surfactant and ethoxylated aryl alcohol.

The compositions may further include hydrotopes, enzymes, enzyme stabilizing system, chelating agents, sequestering agents, bleaching agents, alkaline source, secondary hardening agent or solubility modifier, detergent filler, defoamer, anti-redeposition agent, a threshold agent or system, aesthetic enhancing agent (i.e. dye, perfume, ect.) and the like. Adjuvants and other additive ingredients will vary according to the type of composition being manufactured and can be included in the compositions in any amount.

Hydrotope

The composition can include a hydrotope. Any suitable hydrotope can be employed. Specifically, the hydrotope can be an aromatic sulfonic acid salt of the formula:

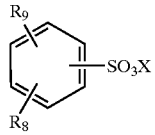

or of the formula:

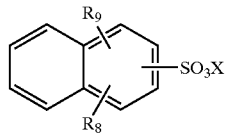

where $R_8$ and $R_9$ can each independently $(C_1–C_6)$alkyl where any alkyl can be substituted with one or more hydroxy; X may be sodium, potassium, lithium, or $^+NHR_{10}R_{11}R_{12}$, where $R_{10}–R_{12}$ are each independently H or $(C_1–C_6)$alkylene, where the alkylene can be substituted with one or more hydroxy.

A preferred value for $R_8$ is methyl, ethyl, propyl, or iso-propyl. More preferably, $R_8$ is methyl. A preferred value for $R_9$ is methyl, ethyl, propyl, or iso-propyl. More preferably, $R_9$ is methyl. A preferred value for X is sodium (i.e., Na).

Suitable aromatic sulfonic acid salts include sodium xylene sulfonate, which is commercially available as Stepanate SXS (CAS #1300-72-7) from Stepan or a distributor of Stepan, such as Milsolv Corporation (Roseville, Minn.); sodium naphthalene sulfonate; and sodium cumene sulfonate. The aromatic sulfonic acid salt can be present in any suitable amount of the composition, provided the composition can effectively degrease or clean surfaces. As will be apparent to those skilled in the art, the above-listed hydrotopes are merely illustrative and various other hydrotopes meeting the criteria set out above may also be used in the practice of the invention. The hydrotopes may be present in the composition from 0.01 wt % or 0.5 to 10 wt %.

Oxygenated Solvent

The compositions of the invention can contain a compatible non-aqueous oxygenated solvent. Oxygenated solvents include lower alkanols, lower alkyl ethers, glycols, aryl glycol ethers and lower alkyl glycol ethers. These materials are colorless liquids with mild pleasant odors, are excellent solvents and coupling agents and may be miscible with aqueous use compositions of the invention. Examples of useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers and ethylene glycol phenyl ether. The glycol ethers include lower alkyl $(C_{1-8}$ alkyl) ethers including propylene glycol methyl ether, propylene glycol butyl ether, propylene glycol propyl ether, dipropylene glycol methyl ether, dipropylene glycol butyl ether, tripropylene glycol methyl ether, ethylene glycol butyl ether, diethylene glycol methyl ether, diethylene glycol butyl ether, ethylene glycol dimethyl ether, ethylene glycol monobutyl ether, and others. The solvent capacity of the cleaners can be augmented by using monoalkanol amines.

As will be apparent to those skilled in the art, the above-listed solvents are merely illustrative and various other solvents meeting the criteria set out above may also be used in the practice of the invention.

The oxygenated solvent may be present in the composition from 0.01 wt % or 0.1 to 99 wt % or 5 to 50 wt % or 1 to 20 wt %.

Enzymes

The composition of the invention may includes one or more enzymes, which can provide desirable activity for removal of protein-based, carbohydrate-based, or triglyceride-based stains from substrates; for cleaning, destaining, and sanitizing presoaks, such as presoaks for flatware, cups and bowls, and pots and pans; presoaks for medical and dental instruments; or presoaks for meat cutting equipment; for machine warewashing; for laundry and textile cleaning and destaining; for carpet cleaning and destaining; for cleaning-in-place and destaining-in-place; for cleaning and destaining food processing surfaces and equipment; for drain cleaning; presoaks for cleaning; and the like. Enzymes may act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes may include a protease, an amylase, a lipase, a gluconase, a cellulase, a peroxidase, or a mixture thereof of any suitable origin, such as vegetable, animal, bacterial, fungal or yeast origin. Selections are influenced by factors such as pH-activity and/or stability optima, thermostability, and stability to active detergents, builders and the like. In this respect bacterial or fungal enzymes may be preferred, such as bacterial amylases and proteases, and fungal cellulases. Preferably the enzyme may be a protease, a lipase, an amylase, or a combination thereof. Enzyme may be present in the composition from at least 0.01 wt %, or 0.01 to 2 wt %.

Enzyme Stabilizing System

The composition of the invention may include an enzyme stabilizing system. The enzyme stabilizing system can include a boric acid salt, such as an alkali metal borate or amine (e.g. an alkanolamine) borate, or an alkali metal borate, or potassium borate. The enzyme stabilizing system can also include other ingredients to stabilize certain enzymes or to enhance or maintain the effect of the boric acid salt.

For example, the cleaning composition of the invention can include a water soluble source of calcium and/or magnesium ions. Calcium ions are generally more effective than magnesium ions and are preferred herein if only one type of cation is being used. Cleaning and/or stabilized enzyme cleaning compositions, especially liquids, may include 1 to 30, 2 to 20, or 8 to 12 millimoles of calcium ion per liter of finished composition, though variation is possible depending on factors including the multiplicity, type and levels of enzymes incorporated. Water-soluble calcium or magnesium salts may be employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

Stabilizing systems of certain cleaning compositions, for example warewashing stabilized enzyme cleaning compositions, may further include 0 to 10%, or 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions are known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

Chelating/Sequestering Agent

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. The composition may include 0.1–70 wt %, or 5–60 wt %, of a chelating/sequestering agent. An iminodisuccinate (available commercially from Bayer as IDS™) may be used as a chelating agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like.

The composition may include a phosphonate such as 1-hydroxyethane-1,1-diphosphonic acid and the like.

Polymeric polycarboxylates may also be included in the composition. Those suitable for use as cleaning agents have pendant carboxylate groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339–366 and volume 23, pages 319–320, the disclosure of which is incorporated by reference herein.

Bleaching Agents

Bleaching agents for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents include, for example, chlorine-containing compounds such as a chlorine, a hypochlorite, chloramine. Halogen-releasing compounds may include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, such as 0.1–10 wt %, or 1–6 wt %.

Detergent Builders or Fillers

A composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$–$C_{10}$ alkylene glycols such as propylene glycol, and the like. Inorganic or phosphate-containing detergent builders may include alkali metal, ammonium and alkanolammonium salts of polyphosphates (e.g. tripolyphosphates, pyrophosphates, and glassy polymeric meta-phosphates). Non-phosphate builders may also be used. A detergent filler may be included in an amount of 1–20 wt %, or 3–15 wt %.

Defoaming Agents

A minor but effective amount of a defoaming agent for reducing the stability of foam may also be included in the compositions. The cleaning composition can include 0.01–5 wt % of a defoaming agent, or 0.01–3 wt %.

Examples of defoaming agents include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-redeposition Agents

The composition may include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. The composition may include 0.5–10 wt %, or 1–5 wt %, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as ClS-jasmine or jasmal, vanillin, and the like.

Alkalinity Source

An alkalinity source may be provided to increase the pH of composition. Exemplary alkalinity sources include an alkali metal silicate, hydroxide, phosphate, carbonate or organic alkalinity source.

The alkalinity source can include an alkali metal hydroxide including sodium hydroxide, potassium hydroxide, lithium hydroxide, etc. Mixtures of these hydroxide species can also be used. Alkaline metal silicates can also act as a source of alkalinity for the detergents of the invention.

The alkalinity source can include an alkali metal carbonate. Alkali metal carbonates which may be used include sodium carbonate, potassium carbonate, sodium or potassium bicarbonate or sesquicarbonate, among others. These sources of alkalinity can be used the compositions of the invention at concentrations of 0.1 wt-% to 70 wt-%, 1 wt-% to 30 wt-%, or 5 wt-% to 20 wt-%.

Divalent Ion

The compositions of the invention may contain a divalent ion, selected from calcium and magnesium ions, at a level of from 0.05% to 5% by weight, or from 0.1% to 1% by weight, or 0.25% by weight of the composition. The divalent ion can be, for example, calcium or magnesium. The calcium ions can, for example, be added as a chloride, hydroxide, oxide, formate, acetate, nitrate salt.

The above compositions can be made by combining water with a terpene and a ethoxylated phenol defined above to form a stable solution. The above processes can be used to produce a product having a stable solution. The compositions can be diluted with aqueous and/or non aqueous materials to form a use solution of any strength depending on the application. The compositions and diluted use solutions may be useful as, for example, detergents for laundry, warewashing, vehicle care, sanitizing, ect.

EXAMPLES

A formulation was created by combining the components in the amounts listed in the tables below.

Formulation A

| Component | Wt % |
|---|---|
| Water | 53.4 |
| Tall Oil Fatty Acid | 2 |
| Monoisopropanolamine | 2.8 |
| Versene 100 (Na EDTA) | 2.8 |
| D'limonene | 10 |
| Ethylan HB4 | 10 |
| SXS 40% | 2 |
| Neodol 1-7 | 12 |
| Neodol 1-3 | 5 |

Ethylan HB4 is an ethylene glycol phenol ether (EPH) with 4 moles of ethylene oxide and is commercially available from Akzo Nobel N. V., (Arnhem, Netherlands). SXS 40%(sodium xylene sulfonate) is commercially available as Stepanate SXS (CAS #1300-72-7) from Stepan or a distributor of Stepan, such as Milsolv Corporation (Roseville, Minn.). Monoisopropanolamine and Versene 100 are commercially available from the Dow Chemical Co.,(Midland, Mich.). Neodol 1-7 and Neodol 1-2 is commercially available from Shell Chemical Co.

Formulation A above provide a cleaning solution that can be used as a dilutable degreaser for stainless steel surfaces, a non-dilutable aluminum pan cleaner that is metal safe, a hard surface cleaner, a graffiti remover or a floor cleaner and the like. Formulation A also exhibits stability in the above concentrate form and when diluted to a use solution.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A composition comprising:

(a) a terpene compound;

(b) a surfactant; and (c) an ethoxylated aryl alcohol having the formula:

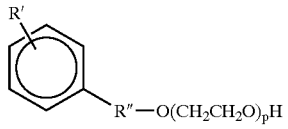

wherein, p is an interger from 2 to 5;

R' is hydrogen; and

R" is a $(C_2–C_3)$alkyl, $(C_2–C_3)$alkoxy, or $(C_2–C_3)$alkenyl.

2. The composition according to claim 1, wherein the surfactant comprises an amine salt of a fatty acid.

3. The composition according to claim 1, wherein the surfactant comprises a hydrophilic alcohol ethoxylate.

4. The composition according to claim 1, wherein the surfactant comprises a hydrophobic alcohol ethoxylate.

5. The composition according to claim 1, further comprising water.

6. The composition according to claim 1, further comprising a builder.

7. The composition according to claim 6, wherein the builder is chelating agent.

8. The composition according to claim 7, wherein the chelating agent is sodium ethylenediaminetetraacetic acid.

9. The composition according to claim 1, further comprising a hydrotope.

10. The composition according to claim 9, wherein the hydrotope is sodium xylene sulfonate.

11. The composition according to claim 1, further comprising a glycol ether.

12. The composition according to claim 1, wherein the terpene comprises d-limonene.

13. A composition comprising:

(a) 1–65% wt D-limonene compound;

(b) 0.5–40% wt surfactant; and (c) 0.5–40% wt. of an ethoxylated aryl alcohol having the formula:

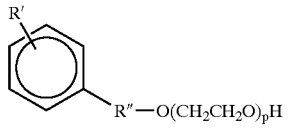

wherein, p is an interger from 2 to 3;

R' is hydrogen; and

R" is a bond.

14. The composition according to claim 13, wherein the surfactant comprises an amine salt of a fatty acid wherein the amine salt of a fatty acid comprises a $(C_8–C_{22})$ fatty acid anion and a cation of the formula $NR_4$ where $R_4$ is one or two groups independently selected from hydrogen, $(C_1–C_{18})$ alkyl, $(C_1–C_{18})$alkoxy, or $(C_2–C_{18})$alkenyl.

15. The composition according to claim 13, wherein the surfactant comprises a hydrophilic alcohol ethoxylate having a formula (II):

$$R_2—(OC_2H_4)_m—(OC_3H_6)_n—OH \quad \text{(II)}$$

wherein, $R_2$ is a $(C_6–C_{24})$alkyl, in is an integer of 5 to 12, n is an integer of 0 to 6 and m+n is and integer of 6 to 20.

16. The composition according to claim 13, wherein the surfactant comprises a hydrophobic alcohol ethoxylate having a formula (III):

$$R_3—(OC_2H_4)_r—(OC_3H_6)_s—OH \quad \text{(III)}$$

wherein, $R_3$ is a $(C_6–C_{24})$alkyl, r is an integer of 1 to 2, s is an integer of 0 to 2 and r+s is and integer of 1 to 2.

17. The composition according to claim 13, further comprising water.

18. The composition according to claim 13, further comprising a chelating agent.

19. The composition according to claim 13, further comprising a hydrotope.

20. The composition according to claim 19, wherein the hydrotope is sodium xylene sulfonate.

21. The composition according to claim 13, further comprising a glycol ether.

22. A method of forming a stable cleaning concentrate comprising: combining:

(a) a D-limonene compound;

(b) an ethoxylated aryl alcohol having the formula:

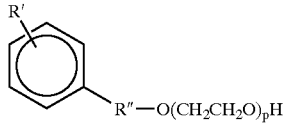

wherein, p is 4;

R' is hydrogen; and

R" is a bond;

(c) an amine salt of a fatty acid;

(d) a hydrophilic alcohol ethoxylate;

(e) a hydrophobic alcohol ethoxylate; and (f) water;

to form a stable cleaning concentrate having at least 10 wt % d-limonene and 10 wt % ethoxylated aryl alcohol.

23. The method according to claim 22, further comprising diluting the stable cleaning concentrate with water to form a stable dilute cleaning concentrate.

* * * * *